US009938646B2

(12) United States Patent
Hamada et al.

(10) Patent No.: US 9,938,646 B2
(45) Date of Patent: Apr. 10, 2018

(54) WOVEN BAND WITH DIFFERENT STRETCH REGIONS

(71) Applicant: Apple Inc., Cupertino, CA (US)

(72) Inventors: Yoji Hamada, Tokyo-to (JP); Matthew D. Rohrbach, Cupertino, CA (US); Daniel A. Podhajny, Cupertino, CA (US); Ying-Liang Su, Shenzhen (CN); Douglas J. Weber, San Francisco, CA (US); Benjamin A. Shaffer, Cupertino, CA (US); Motohide Hatanaka, Tokyo-to (JP)

(73) Assignee: APPLE INC., Cupertino, CA (US)

( * ) Notice: Subject to any disclaimer, the term of this patent is extended or adjusted under 35 U.S.C. 154(b) by 0 days.

(21) Appl. No.: 14/796,528

(22) Filed: Jul. 10, 2015

(65) Prior Publication Data

US 2016/0255921 A1 Sep. 8, 2016

Related U.S. Application Data

(60) Provisional application No. 62/129,912, filed on Mar. 8, 2015.

(51) Int. Cl.
*D03D 47/34* (2006.01)
*D03D 3/00* (2006.01)
(Continued)

(52) U.S. Cl.
CPC ..... *D03D 47/347* (2013.01); *D03D 3/005* (2013.01); *D03D 13/00* (2013.01); *D03D 15/08* (2013.01);
(Continued)

(58) Field of Classification Search
CPC ..... D03D 15/08; D03D 15/00; D03D 13/00; D03D 2700/0103; D10B 2401/061; D10B 2501/00; A44C 5/00
See application file for complete search history.

(56) References Cited

U.S. PATENT DOCUMENTS 2,696,839 A 12/1954 Schuerhoff
3,189,972 A * 6/1965 Vernier ..... D03D 15/08 139/423
(Continued)

FOREIGN PATENT DOCUMENTS

BE 555150 2/1957
CH 335252 2/1959
(Continued)

*Primary Examiner* — Bobby Muromoto, Jr.
(74) *Attorney, Agent, or Firm* — McDermott Will & Emery LLP

(57) ABSTRACT

A wearable band includes a woven material having two or more stretch regions. The different stretch regions can be formed by varying the tension on subsets of the warp threads, the weft threads, or both the warp and weft threads. A system for producing the woven material can include two or more tension control devices operably connected to a processing device. Each tension control device is configured to adjust the amount of tension in a respective subset of threads (e.g., warp threads) in the woven material during a weaving operation. The processing device is configured to select thread tension patterns for the subsets of threads used during the weaving operation. Each thread tension pattern includes tension settings for the subsets of threads, where at least one tension setting in one thread tension pattern differs from the tension settings in the other tension patterns.

17 Claims, 6 Drawing Sheets

(51) Int. Cl.

| | |
|---|---|
| ***D03D 13/00*** | (2006.01) |
| ***D03D 15/08*** | (2006.01) |
| ***D03D 49/04*** | (2006.01) |
| *A44C 5/00* | (2006.01) |

(52) U.S. Cl.
CPC ..... *D03D 49/04* (2013.01); *A44C 5/0053* (2013.01); *A44C 5/0069* (2013.01)

(56) References Cited

U.S. PATENT DOCUMENTS

| | | | | |
|---|---|---|---|---|
| 3,362,595 | A | 1/1968 | Herzog | |
| 3,685,549 | A * | 8/1972 | Goff | D03D 15/08 139/24 |
| 3,885,383 | A | 5/1975 | Tanaka | |
| 4,585,037 | A | 4/1986 | Kimbara | |
| 4,662,407 | A | 5/1987 | Duncan | |
| 4,748,078 | A | 5/1988 | Doi et al. | |
| 4,846,230 | A | 7/1989 | Mock et al. | |
| 5,089,669 | A | 2/1992 | Piper et al. | |
| 5,219,636 | A | 6/1993 | Golz | |
| 5,437,314 | A | 8/1995 | Sainen | |
| 5,438,851 | A | 8/1995 | Geissbuhler | |
| 5,465,762 | A | 11/1995 | Farley | |
| 5,529,826 | A | 6/1996 | Tailor et al. | |
| 6,095,449 | A * | 8/2000 | Gallo | B65H 59/225 139/452 |
| 6,336,475 | B2 | 1/2002 | Dewispelaere et al. | |
| 6,376,047 | B1 | 4/2002 | Hasegawa | |
| 6,814,754 | B2 * | 11/2004 | Greenhalgh | A61F 2/06 623/1.51 |
| 7,143,437 | B2 | 11/2006 | Royer et al. | |
| 7,275,667 | B2 | 10/2007 | Bertucci | |
| 7,836,917 | B1 | 11/2010 | Osborne | |
| 7,849,888 | B2 * | 12/2010 | Karayianni | D03D 1/0088 139/383 R |
| 7,909,066 | B2 | 3/2011 | Wada | |
| 8,039,083 | B2 | 10/2011 | Higashinaka et al. | |
| 8,603,374 | B2 | 12/2013 | Domagalski et al. | |
| 8,651,150 | B2 | 2/2014 | Siebert | |
| 2003/0101549 | A1 * | 6/2003 | Wang | A44B 18/0023 24/451 |
| 2006/0166577 | A1 | 7/2006 | Rashed | |
| 2006/0281382 | A1 * | 12/2006 | Karayianni | D03D 1/0088 442/181 |
| 2007/0265533 | A1 * | 11/2007 | Tran | A61B 5/021 600/481 |
| 2009/0138070 | A1 * | 5/2009 | Holzer | A61F 2/07 623/1.15 |
| 2009/0159149 | A1 * | 6/2009 | Karayianni | D03D 1/0088 139/425 R |
| 2010/0137679 | A1 * | 6/2010 | Lashinski | A61B 17/0401 600/37 |
| 2010/0316229 | A1 * | 12/2010 | Bibl | H04R 1/1033 381/74 |
| 2010/0331612 | A1 * | 12/2010 | Lashinski | A61B 17/0401 600/37 |
| 2011/0074380 | A1 * | 3/2011 | Jeon | D03D 13/00 323/318 |
| 2013/0008554 | A1 | 1/2013 | Fisher et al. | |
| 2014/0135906 | A1 | 5/2014 | Winner et al. | |
| 2014/0276275 | A1 * | 9/2014 | Stokes | A61H 1/008 601/84 |
| 2015/0342307 | A1 * | 12/2015 | Weber | A44C 5/00 368/282 |
| 2016/0037866 | A1 | 2/2016 | Rohrbach et al. | |
| 2016/0258085 | A1 * | 9/2016 | Hatanaka | D03D 11/00 |

FOREIGN PATENT DOCUMENTS

| | | |
|---|---|---|
| CN | 201546014 | 8/2010 |
| CN | 203382963 | 1/2014 |
| CN | 203513965 | 4/2014 |
| EP | 0036527 | 3/1981 |
| FR | 1217530 | 5/1960 |
| JP | 2006130167 | 5/2006 |
| JP | 2012172281 | 9/2012 |
| WO | WO2009059209 | 5/2009 |

* cited by examiner

WOVEN BAND WITH DIFFERENT STRETCH REGIONS

CROSS-REFERENCE TO RELATED APPLICATION(S)

This application claims the benefit under 35 U.S.C. § 119(e) of U.S. Provisional Patent Application No. 62/129,912, filed Mar. 8, 2015 and titled "Woven Band With Different Stretch Regions," the disclosure of which is hereby incorporated herein by reference in its entirety.

FIELD

This application relates generally to woven materials, and more particularly to a woven material configured to have different stretch regions.

BACKGROUND

Conventional woven material or fabric is used in multiple applications and industries. For example, woven material is used in clothing (e.g., shirts, pants, skirts, etc.), in fashion accessories (e.g., bracelets, watch bands, necklaces, etc.), in electronics (e.g., woven conductive layers, protective outer sheath for optical fiber cables), and other various industrial applications (e.g., rope, tape, protective gear, household/kitchenware). Due to the many uses and applications, conventional woven material is manufactured using specific material or manufactured to include specific physical properties. For example, where the woven material is used to form a bracelet or necklace, it may be desired that the woven material be flexible to contour around the surface in which the woven material is worn (e.g., wrist, neck). Additionally, it may be desired that the woven material forming the bracelet or necklace be durable, flexible and/or capable of withstanding typical wear/treatment of a bracelet or necklace. Furthermore, it may be desired that the woven material forming the bracelet or necklace be capable of forming unique designs or cosmetic embellishments including unique color patterns or portions having varied dimensions (e.g., tapered portions).

When an elastic woven material is fabricated, individual elastic threads are woven in an interlaced pattern to form the woven material. Warp threads are the longitudinal or lengthwise threads and weft threads are the transverse threads. During a weaving operation, the warp threads are held in tension on a frame or on the loom while the weft threads are drawn or inserted between the warp threads. In other words, the weft threads are inserted over and under the warp threads to produce the woven material.

Typically, a tension controller in a loom cannot change the tension in the elastic threads quickly during a weaving operation. The tension controller needs a given thread length to change the amount of tension in the elastic threads. For example, a tension controller can require two to three hundred millimeters of elastic thread to change the tension in the elastic warp threads. Thus, in some situations, a short length of woven material cannot be produced with different stretch regions (e.g., regions of varied stretchiness) . The length of the woven material may be shorter than the minimum length needed to change the tension in the elastic warp threads.

SUMMARY

Generally, embodiments discussed herein relate to a woven material that is configured to have different stretch regions. The different stretch regions are created by varying the amounts of tension in subsets of thread during a weaving operation. For example, the length of the woven material can be divided into segments. The threads in each segment may be grouped into subsets of threads. In one embodiment, the warp threads are grouped into subsets of warp threads. The different stretch regions can be created in the woven material by varying the amounts of tension in the subsets of threads in at least one segment of the woven material.

In one aspect, a wearable band includes a woven material that has two or more different stretch regions, where an amount of tension in at least one thread in one stretch region varies from the amount of tension in the threads in another stretch region. For example, in one embodiment the amount of tension in the warp threads varies over the length of the woven material to produce the two or more stretch regions in the woven material. The warp threads can be divided into two or more subsets of warp threads, and the length of the woven material may be divided into two or more segments. The amount of tension in one subset of warp threads is different from the amount of tension in another subset of warp threads in the same segment. Collectively, the particular amounts of tension in all of the subsets of warp threads in a respective segment of the woven material produce a given amount of stretch or tension in the segment. In some embodiments, the wearable band is configured to attach to a housing of the electronic device and to a user. For example, the wearable band can attach to the wrist of a user.

In another aspect, a woven material includes two or more different stretch regions over a length of the woven material. The length of the woven material is divided into two or more segments and each stretch region is associated with a respective segment. A method for producing the woven material may include weaving a first segment of the woven material using one or more thread tension patterns, and weaving a second segment of the woven material immediately adjacent to the first segment using one or more different thread tension patterns. Each thread tension pattern includes tension settings for subsets of warp threads in a segment of the woven material.

In yet another aspect, system for producing a woven material that has two or more different stretch regions can include two or more tension control devices operably connected to a processing device. Each tension control device includes a tension regulator that is configured to adjust an amount of tension in a respective subset of warp threads in the woven material. The processing device may be configured to select a thread tension pattern from a plurality of thread tension patterns for the two or more subsets of warp threads. Each thread tension pattern includes tension settings for the two or more subsets of warp threads in a segment. Each thread tension pattern includes at least one tension setting for one subset of warp threads that differs from the tension settings for another subset of warp threads.

BRIEF DESCRIPTION OF THE DRAWINGS

The disclosure will be readily understood by the following detailed description in conjunction with the accompanying drawings, wherein like reference numerals designate like structural elements, and in which.

DETAILED DESCRIPTION

Reference will now be made in detail to representative embodiments illustrated in the accompanying drawings. It should be understood that the following descriptions are not intended to limit the embodiments to one preferred embodiment. To the contrary, it is intended to cover alternatives, modifications, and equivalents as can be included within the spirit and scope of the described embodiments as defined by the appended claims Embodiments herein disclose a wearable band that is formed with a woven material that includes two or more regions of different stretchiness, and a method of producing such a woven material. The wearable band may be configured to attach to a housing of an electronic device. The wearable band can also be configured to attach to a user (e.g., a wrist of a user). The different stretch regions may be formed by varying the tension on subsets of the warp threads, the weft threads, or both the warp and weft threads during a weaving operation.

Each stretch region is associated with a segment of the woven material. When a segment of the woven material is fabricated, the tension on one subset of threads, such as one subset of warp threads, can vary from the tension on another subset of warp threads in the same segment of the woven material. For example, the length of a woven material can be divided into multiple distinct segments. Each segment corresponds to a particular stretch region in the woven material. The warp threads in the woven material may be divided into subsets. The amount of tension in a subset of warp threads can vary over the length of the woven material. Collectively, the varied tensions on the different subsets of warp threads produce a woven material that has different stretch regions over the length of the woven material.

These and other embodiments are discussed below with reference to FIGS. 1-7. However, those skilled in the art will readily appreciate that the detailed description given herein with respect to these Figures is for explanatory purposes only and should not be construed as limiting.

Figure 1:
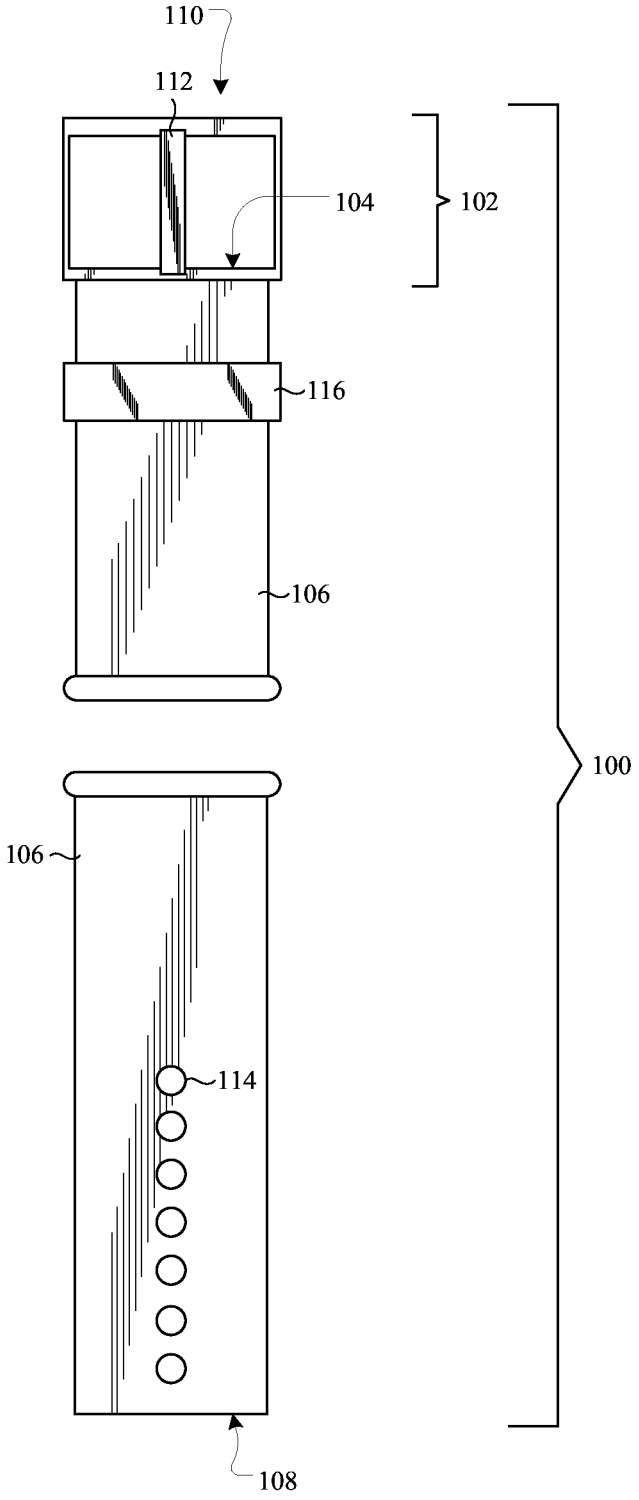
FIG. 1 shows a plan view of a wearable band that may be made of a woven material.

FIG. 1 shows a plan view of a wearable band that may be made of a woven material. In non-limiting examples, the wearable band 100 may be configured as a decorative band (e.g., wristband, armband, headband, necklace, etc.), a watch band, or a wearable band for holding an electronic device. Example electronic devices include, but are not limited to, a smartphone, a gaming device, a display, a digital music player, a wearable computing device or display, and a health monitoring device. As shown in FIG. 1, the wearable band 100 is a wrist band that may be coupled to a housing of a wearable electronic device, although (and as mentioned) it may be connect to, or otherwise used with, non-electronic devices such as certain watches, luggage, jewelry, articles of clothing and so on. In certain embodiments the band may be a part of a larger object. For example, the band may be part of a shirt, pants or other article of clothing. Continuing the example, the band may be the end of an arm of a shirt. In such embodiments, the band may be woven, created, or otherwise implemented into the larger object or may be separate and added into or onto the larger object.

The wearable band 100 may include a connection device 102 positioned at a first end 104 of the wearable band. Any suitable technique may be used to affix the connection device 102 to the woven material 106 that forms the wearable band 100. Connection device 102 is configured to releasably couple the ends 104, 108 to secure the wearable band 100 to a user. The connection device 102 may be any suitable coupling mechanism capable of releasably coupling the ends 104, 108 together.

As shown in FIG. 1, the illustrated connection device 102 includes a buckle 110 that is affixed to the first end 104. The buckle 110 can be attached to the first end 104 using any suitable technique. A tongue 112 is affixed to the buckle 110. To secure the wearable band 100 to the user, a portion of the second end 108 of the wearable band 100 is received by the buckle 110 and the tongue 112 is positioned within one of the holes 114 formed adjacent to the second end 108. The holes 114 can be formed through the wearable band 100 using any suitable process technique including, but not limited to, laser cutting, shearing, or punching.

In some embodiments, the second end 108 may be further secured to the wearable band 100 using a retention loop 116 positioned substantially around the wearable band 100. The retention loop 116 may form an opening (not shown) between the wearable band 100 and the underside of the retention loop 116. The opening receives the second end 108 and positions the second end 108 against a portion of the wearable band 100.

The woven material 106 forming the wearable band 100 may be formed from a large piece of woven material that may be substantially cut or shaped to a desired size. In a non-limiting example, the woven material 106 may be cut from a larger piece of woven material 106 to form the wearable band 100 using a laser cutting process. The laser used in the laser cutting process may cut a larger piece of woven material 106 to produce the desired dimensions of the wearable band 100. Additionally, the laser in the laser cutting process may simultaneously cauterize or round the edges of the woven material 106 forming the wearable band 100 to prevent fraying of the woven material 106. Although discussed herein as being laser cut, it is understood that the woven material 106 may undergo any suitable cutting or shearing process to form the wearable band 100.

Although shown as two distinct portions, it is understood that the wearable band 100 may be formed from a single piece of woven material 106. In one non-limiting example, the single piece of woven material 106 forming the wearable band 100 may have elastic properties, such that the wearable band 100 may be a single, continuous loop of woven material 106 and may stretch around a user's wrist. In another non-limiting example, the single piece of woven material 106 forming the wearable band 100 may have a loop positioned on the first end 102 that may receive the second end 108, and the second end 108 may be folded back onto and coupled to portions of the wearable band 100 to secure the wearable band 100 to a user's wrist. Any suitable coupling component or feature may couple the folded portion of the second end 108 to the wearable band 100 including, but not limited to, Velcro, magnets, clips, and so on.

Additionally, although discussed herein as being formed from a large piece of woven material 106, it is understood that wearable band 100 may be formed by weaving threads to size. That is, in a non-limiting example, the wearable band 100 may not be cut from a larger piece of woven material 106, but rather the woven material 106 may be woven to a desired size of the wearable band 100, and may not undergo a cutting process. However, in the non-limiting example where the wearable band 100 is formed from woven material 106 woven to size, the ends of woven material 106 may undergo additional processes, for example crimping, to improve physical characteristics or visual or tactile features.

When forming the woven material 106 that will be used in the wearable band 100, it may be desirable to produce the woven material with different stretch regions. The wearable band 100 may then have a varying stretchiness over the length and/or width of the wearable band. One region of the band can stretch more (or less) than another region of the wearable band 100.

Figure 2:
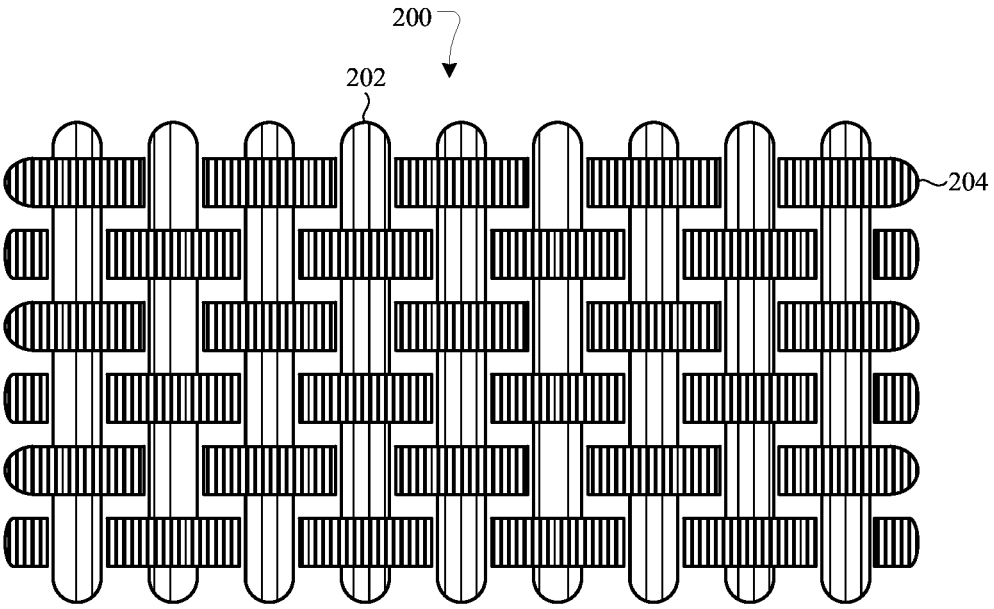
FIG. 2 shows a plan view of a woven material.

FIG. 2 shows a plan view of a woven material. The woven material 200 is formed by weaving threads in an interlaced pattern, such as, for example, by weaving the threads at right angles. Warp threads 202 are the longitudinal or lengthwise threads and weft threads 204 are the transverse threads. The woven material, or fabric, is typically woven on a loom. The warp threads 202 are held in tension on the loom. The weft threads 204 are then drawn or inserted through the warp threads 202. The weft threads 204 are inserted between (e.g., over and under) the warp threads. The way the warp and weft threads interlace with each other is called the weave. The warp and weft threads can have the same color, or the warp and weft threads can have different colors that are woven to produce decorative or artistic designs.

In one embodiment, both the warp and the weft threads are elastic threads. The elasticity of the warp and weft threads can be the same or the elasticity of the warp threads may be different from the elasticity of the weft threads. Alternatively, warp threads having different amounts of elasticity can be used. Additionally or alternatively, weft threads having different amounts of elasticity can be used.

Figure 3:
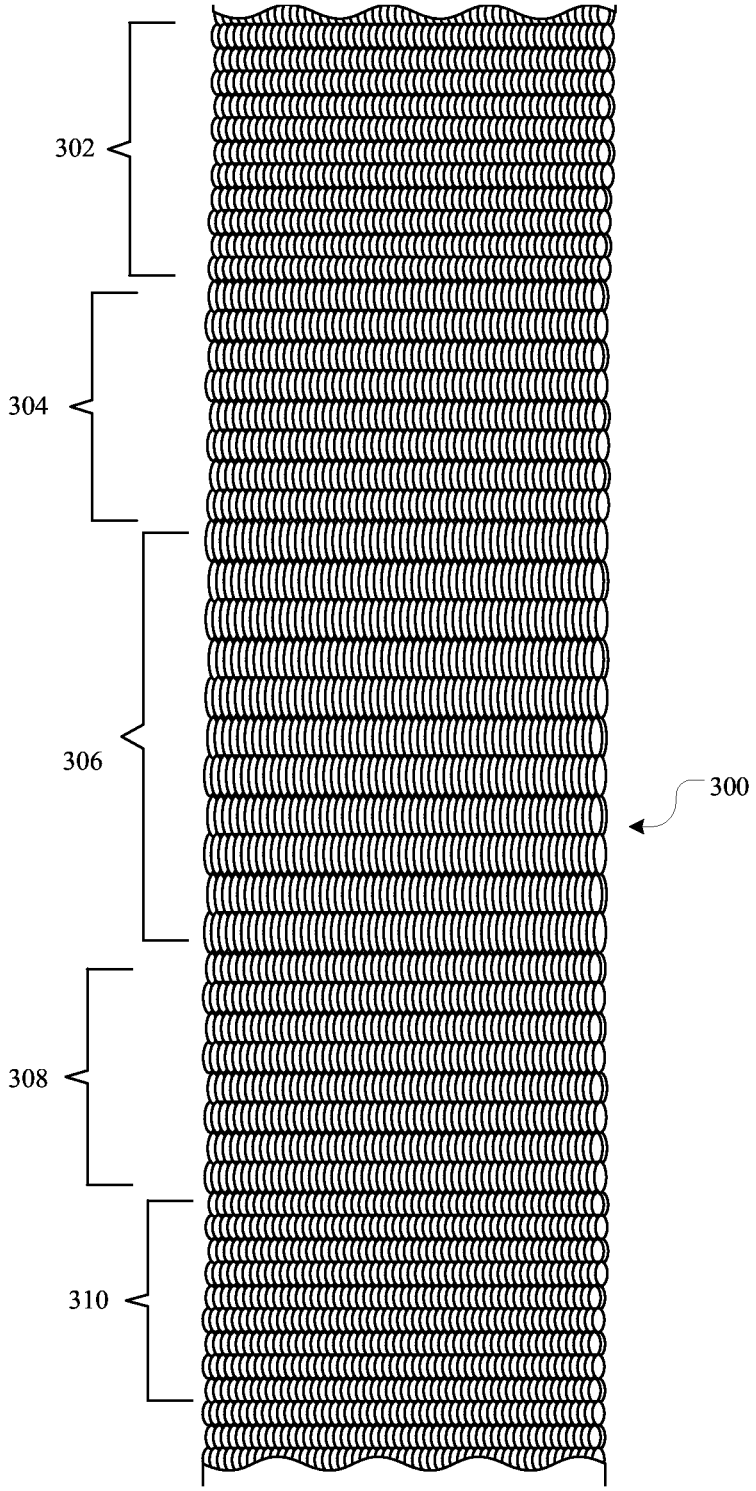
FIG. 3 shows a plan view of a woven material configured to have different stretch regions.

FIG. 3 shows a plan view of a woven material that is configured to have different stretch regions. In the illustrated embodiment, the woven material 300 has five stretch regions 302, 304, 306, 308, 310. Each stretch region can be configured to have a particular amount of stretch. For example, stretch regions 302 and 310 can have no stretch, stretch regions 304 and 308 some stretch, and stretch region 306 the highest amount of stretch. As another example, stretch regions 302 and 310 can have a high amount of stretch, stretch regions 304 and 308 a medium amount of stretch, and stretch region 306 little or no stretch. And in yet another example, stretch regions 302 and 304 can both be one region that has a high amount of stretch, stretch region 306 a medium amount of stretch, and stretch regions 308 and 310 little or no stretch.

In FIG. 3, the density of the woven material varies to illustrate the different amounts of elasticity. The stretch regions 302 and 310 have the highest density to depict little or no stretch. The stretch regions 304 and 308 have a medium density to reflect some stretch. The stretch region 306 has the lowest density to illustrate the highest amount of stretch. In practice, however, the different stretch regions in a woven material may not necessarily have any visible borders, edges, discrepancies, or boundaries. The different stretch regions can have a uniform appearance.

Figure 4:
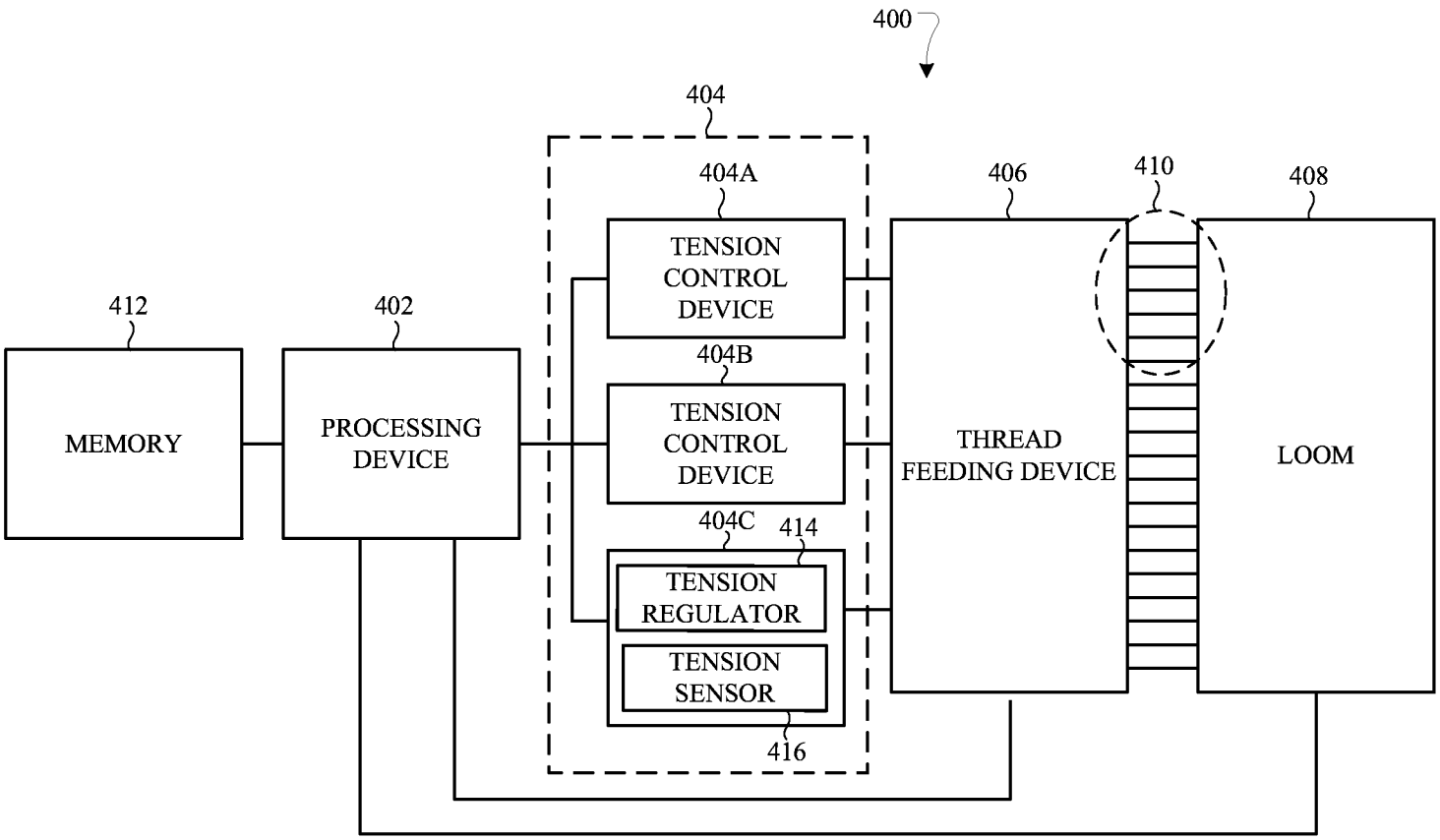
FIG. 4 shows a block diagram of one example of a system that produces a woven material with different stretch regions.

The different stretch regions can be formed by using varying amounts of tension on the warp threads, the weft threads, or both the warp and weft threads. Embodiments described herein produce different amounts of tension in the warp threads during the weaving operation to produce the different stretch regions. FIG. 4 depicts a block diagram of one example of a system that produces a woven material with different stretch regions. The system 400 includes a processing device 402 operably connected to a tension controller 404. Optionally, the processing device 402 may be operably connected to a thread feeding device 406 and a weaving device or loom 408. The processing device 402 can communicate with (either directly or indirectly) and control some or all of the operations of the tension controller 404, the thread feeding device 406, and the loom 408. The processing device 402 can be implemented as any electronic device capable of processing, receiving, or transmitting data or instructions. For example, the processing device 402 can a microprocessor, a central processing unit (CPU), an application-specific integrated circuit (ASIC), a digital signal processor (DSP), or combinations of such devices. As described herein, the term "processing device" is meant to encompass a single processor or processing unit, multiple processors, multiple processing units, or other suitably configured computing element or elements.

In some embodiments, the tension controller 404 includes multiple tension control devices 404A, 404B, 404C. Each tension control device may be configured to adaptively control the amount of tension in a subset of warp threads provided to the loom 408 by the thread feeding device 406. Each tension control device can adjust the amount of tension in a respective subset of warp threads during a weaving operation. For example, in the illustrated embodiment, tension control device 404A may control, and if desired, vary the amount of tension in the warp threads in the circled area 410 during a weaving operation. The amount of tension in another subset of warp threads may be controlled and adjusted by tension control device 404B, and the amount of tension in the remaining subset of warp threads can be controlled and adjusted by tension control device 404C. Collectively, the varied tensions on the different subsets of warp threads produce a woven material that has different stretch regions over the length of the woven material.

Each tension control device 404A, 404B, 404C may include a tension regulator 414 that is configured to adjust the amount of tension in a subset of warp threads, and a tension sensor 416 configured to determine the amount of tension in each subset of warp threads. Any suitable device can be used as a tension regulator and a tension sensor. In some embodiments, the tension regulator and the tension sensor can be constructed as separate devices. In other embodiments, the tension regulator and the tension sensor can be constructed as a single device.

A memory 412 can be operably connected to the processing device 402. The memory 412 can store instructions, application programs, algorithms, and the like that the processing device 402 can execute to control the operations of the tension controller 404 (e.g., each tension control device 404A, 404B, 404C). The memory 412 can be configured as any suitable type of memory. By way of example only, the memory 412 can be implemented as random access memory, read-only memory, Flash memory, removable memory, or other types of storage elements, individually or in any combination.

Figure 5:
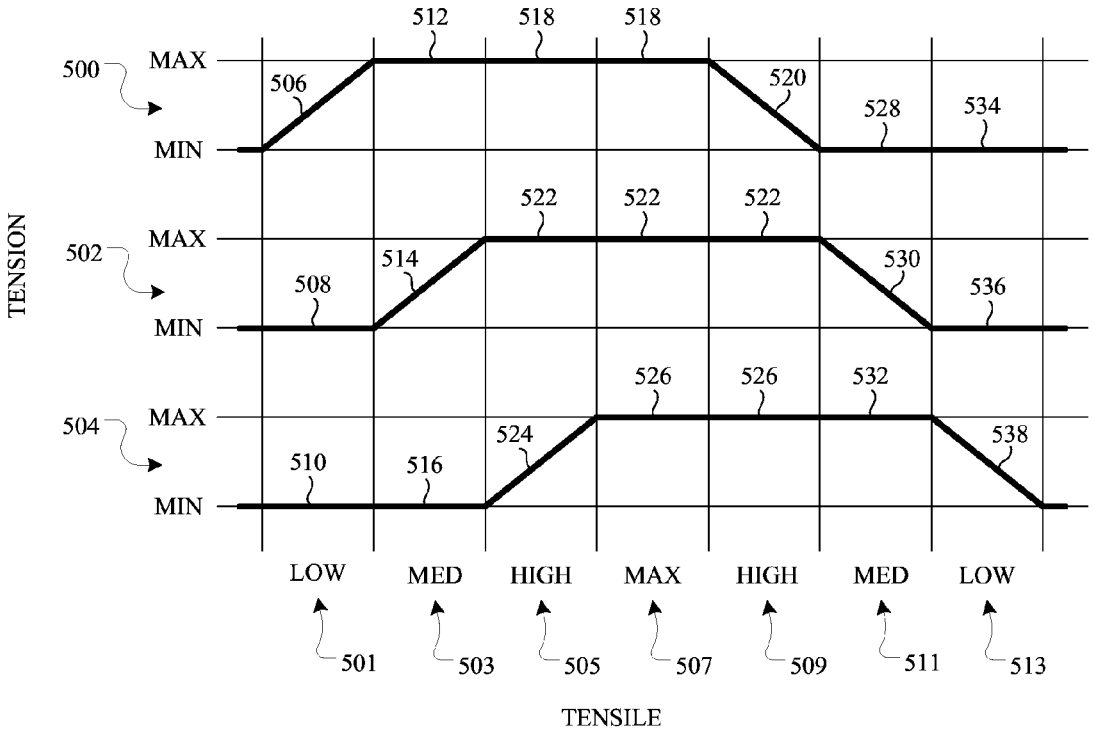
FIG. 5 shows example plots of different thread tension patterns that may be used during a weaving operation to produce different stretch regions in a woven material.

FIG. 5 shows example plots of different thread tension patterns that may be used during a weaving operation to produce different stretch regions in a woven material. In the illustrated embodiment, there are three subsets of warp threads 500, 502, 504 that are provided to a loom. Each plot depicts the amount of tension in a given subset of warp threads. The amount of tension can range from a minimum amount of tension to a maximum amount of tension (see vertical axis). In a non-limiting example, the minimum amount of tension may be 20*c* and the maximum amount of tension may be 120*c*N.

The tensile range that is used during the weaving operation is shown on the horizontal axis. In a non-limiting example, the tensile range can include a low tension region, a medium tensile region, a high tensile region, and a maximum tensile region. Collectively, the varied tensions shown in the plots and applied to the three subsets of warp threads produce a woven material that has different stretch regions over the length of the woven material. The tension of the warp threads over the length of the woven material can vary, which produces regions of distinct stretchiness.

Figure 6:
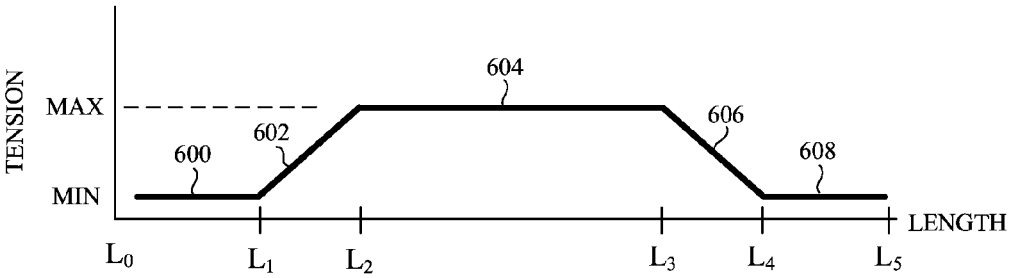
FIG. 6 shows a plot of the tension in a woven material over the length of the woven material that may be produced by the different thread tension patterns shown in FIG. 5.

FIG. 6 shows a plot of the tension in a woven material over the length of the woven material that may be produced by the different thread tension patterns shown in FIG. 5. In the illustrated embodiment, the length of the woven material is divided into five segments 600, 602, 604, 606, and 608. In the non-limiting example, segments 600 and 608 may have a minimum amount of tension, which can result in little or no stretch in those segments 600, 608. The tension in the segment 602 can transition from a minimum amount of tension to a maximum amount of tension, which may produce some stretch in the segment 602. The tension in the segment 604 can be the maximum amount of tension, which may produce the most amount of stretch. And the tension in the segment 606 can transition from the maximum amount of tension to the minimum amount of tension, which may result in some stretch in the segment 606.

The tension settings for the subsets of warp threads 500, 502, 504 that produce a particular tensile value in a segment is known as a thread tension pattern. The thread tension patterns can be stored in a memory, such as memory 412 in FIG. 4.

As shown in FIG. 5, there are four tensile values; low tensile 501 and 513, medium tensile 503 and 511, high tensile 505 and 509, and maximum tensile 507. Different thread tension patterns can be used to produce a particular tensile value. For example, the thread tension pattern for the medium tensile value 503 applies a first set of tension settings in the three subsets of warp threads 500, 502, 504. A maximum amount of tension is applied to the first subset of warp threads 500 (see 512), a tension that transitions from a minimum amount of tension to a maximum amount of tension is applied to the second subset of warp threads (see 514), and a minimum amount of tension is applied to the third subset of warp threads (see 516). The first set of tension settings are applied to the three subsets of warp threads 500, 502, 504 at substantially the same time while a respective segment of the woven material is fabricated.

The thread tension pattern for the medium tensile value 511 applies a different set of tension settings on the three subsets of warp threads 500, 502, 504. A minimum amount of tension is applied to the first subset of warp threads 500 (see 528), a tension that transitions from a maximum amount of tension to a minimum amount of tension is applied to the second subset of warp threads (see 530), and a maximum amount of tension is applied to the third subset of warp threads (see 532). Thus, different combinations of tension settings can be used to produce a given tensile value. In the illustrated embodiment, seven different thread tension patterns are used to produce the four tensile values (low, medium, high, max). In particular, two different thread tension patterns produce two low tensile values, two different thread tension patterns produce two medium tensile values, two different thread tension patterns produce two high tensile values, and one thread tension pattern produces the maximum tensile value.

Referring now to FIG. 6, the tension patterns in FIG. 5 may be used to produce the segments 600, 602, 604, 606, and 608. As one example, the thread tension pattern in 501 can produce segment 600, the thread tension pattern 503 may produce segment 602, the thread tension patterns 505, 507, and 509 can produce segment 604, the thread tension pattern 511 can produce segment 606, and the thread tension pattern 513 may produce segment 513. During a weaving operation, a given thread tension pattern is used when the segment is woven to produce a particular stretchiness (or tension) for that segment. For example, to produce the segment 600 when the segment 600 is woven (the segment from L0 to L1), the thread tension pattern includes transitioning the tension on the first subset of warp threads 500 from the minimum amount of tension to the maximum amount of tension (see 506), setting the tension on the second subset of warp threads 502 to the minimum amount of tension (see 508), and setting the tension on the third subset of warp threads 504 to the minimum amount of tension (see 510).

To produce the segment 602 when the segment 602 is woven(the segment from L1 to L2), the thread tension pattern includes maintaining the tension on the first subset of warp threads 500 at the maximum amount of tension (see 512), transitioning the tension on the second subset of warp threads 502 from the minimum amount to the maximum amount of tension (see 514), and maintaining the tension on the third subset of warp threads 504 at the minimum amount of tension (see 516).

To produce the segment 604 when the segment 604 is woven (the segment from L2 to L3), the thread tension pattern includes initially maintaining the tension on the first subset of warp threads 500 at the maximum amount of tension (see 518) and then transitioning the tension to the minimum amount of tension (see 520), maintaining the tension on the second subset of warp threads 502 at the maximum amount of tension (see 522), and initially transitioning the tension on the third subset of warp threads 504 from the minimum to the maximum amount of tension (see 524) and then maintaining the tension at the maximum amount of tension (see 526).

To produce the segment 606 when the segment 606 is woven (the segment from L3 to L4), the thread tension pattern includes maintaining the tension on the first subset of warp threads 500 at the minimum amount of tension (see 528), transitioning the tension on the second subset of warp threads 502 from the maximum to the minimum amount of tension (see 530), and maintaining the tension on the third subset of warp threads 504 at the maximum amount of tension (see 532).

To produce the segment 608 when the segment 608 is woven (the segment from L4 to L5), the thread tension pattern can include maintaining the tension on the first subset of warp threads 500 at the minimum amount of tension (see 534), maintaining the tension on the second subset of warp threads 502 at the minimum amount of tension (see 536), and transitioning the tension on the third subset of warp threads 504 from the maximum to the minimum amount of tension (see 538).

Other embodiments can determine the amount of tension in each subset of warp threads differently for a given tensile value. Additionally, the tensile range can be configured in a different arrangement and have different tensile values. And, as described earlier, any suitable arrangement of stretch regions can be produced in other embodiments.

Figure 7:
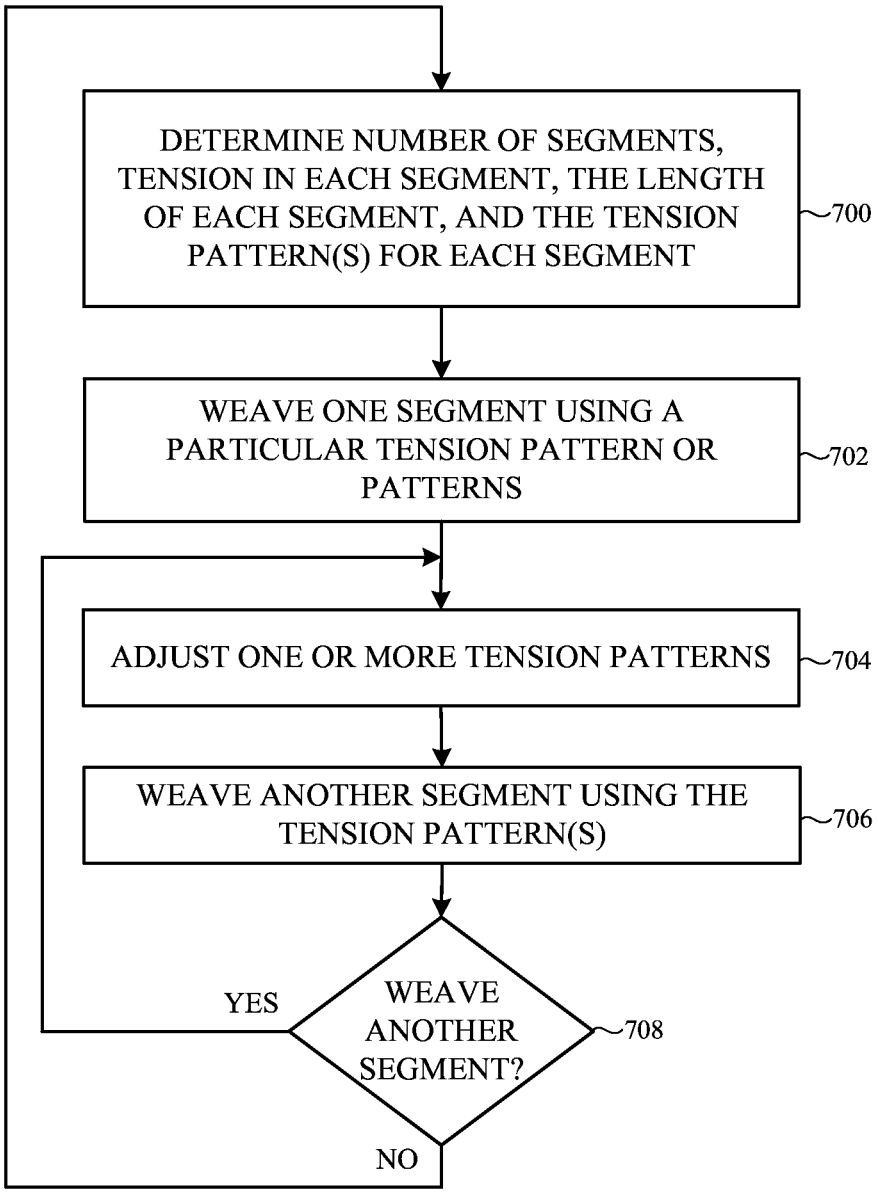
FIG. 7 shows a flowchart of a method for producing a woven material with different stretch regions.

FIG. 7 shows a flowchart of a method for producing a woven material with different stretch regions. Initially, the number of segments and the arrangement of the segments for a woven material are determined, along with the dimensions of each segment and the thread tension pattern or patterns for each segment (block 700). As described earlier, one or more different thread tension patterns can be used to produce one segment. For example, as shown in FIG. 5, three different thread tension patterns 505, 507, 509 can be used to produce the segment 604.

Next, as shown in block 702, a segment of the woven material is fabricated using one or more thread tension patterns. A new thread tension pattern or patterns is selected and another segment is woven using the new thread tension pattern(s) (blocks 704 and 706). A determination may then be made at block 708 as to whether another segment is to be woven. If so, the process returns to block 704. The method returns to block 700 when all of the segments have been woven.

Although the disclosed embodiments have been described as producing different stretch regions in a woven material by varying the amount of tension in two or more subsets of warp threads, other embodiments are not limited to this implementation. Different stretch regions can be created in a woven material by varying the amount of tension in a weft thread. Alternatively, different stretch regions can be produced in a woven material by varying the amount of tension in two or more subsets of warp thread in combination with different amounts of tension on a weft thread.

Additionally, the different stretch regions can be formed by using threads of varying elasticity in addition to varying the amount of tension in two or more subsets of warp threads and/or by varying the amount of tension in a weft thread. For example, threads of different amounts of elasticity can be included in a subset of warp threads, or threads having one amount of elasticity can be included in one subset of warp threads and threads having a different amount of elasticity can be included in another subset of warp threads.

The foregoing description, for purposes of explanation, used specific nomenclature to provide a thorough understanding of the described embodiments. However, it will be apparent to one skilled in the art that the specific details are not required in order to practice the described embodiments. Thus, the foregoing descriptions of the specific embodiments described herein are presented for purposes of illustration and description. They are not targeted to be exhaustive or to limit the embodiments to the precise forms disclosed. It will be apparent to one of ordinary skill in the art that many modifications and variations are possible in view of the above teachings.

What is claimed is:

1. A watch band comprising:

a first band portion comprising an end configured to couple to a housing of a watch;

a second band portion comprising:

a first end comprising a connection device configured to couple to the first band portion;

a second end configured to couple to the housing of the watch; and a woven material between the first end and the second end and having two or more different stretch regions, wherein an amount of tension in threads of the woven material varies in each stretch region to produce the two or more stretch regions.

2. The watch band as in claim 1, wherein the woven material comprises elastic warp threads.

3. The watch band as in claim 2, wherein the amount of tension in the elastic warp threads varies over a length of the woven material to produce the two or more stretch regions.

4. The watch band as in claim 2, wherein all of the elastic warp threads have the same elasticity.

5. The watch band as in claim 2, wherein a first portion of the elastic warp threads have a first elasticity and a second portion of the elastic warp threads have a second elasticity.

6. The watch band as in claim 2, wherein the woven material further comprises one or more elastic weft threads.

7. The watch band as in claim 6, wherein all of the elastic weft threads have the same elasticity.

8. The watch band as in claim 6, wherein a first portion of the elastic weft threads have a first elasticity and a second portion of the elastic weft threads have a second elasticity.

9. The watch band as in claim 1, wherein the watch band is affixed to the watch that displays time.

10. The watch band as in claim 1, wherein the watch band is removably affixed to the watch that comprises a health monitoring device.

11. A watch band comprising:

a woven material having warp threads and weft threads, the woven material having two or more different stretch regions, wherein tension in a first subset of warp threads in a first stretch region differs from tension in a second subset of warp threads in the first stretch region, the difference in tensions being in a directly weft direction, wherein the first stretch region has an elasticity in the first stretch region that is different from an elasticity of a second stretch region adjacent to the first stretch region.

12. The watch band of claim 11, wherein the tension in each subset of warp threads varies over a length of the watch band.

13. The watch band of claim 11, wherein tension in the weft threads in the first stretch region differs from tension in the warp threads in the first stretch region.

14. The watch band of claim 11, wherein the two or more stretch regions do not have any visible borders, edges, discrepancies, or boundaries between the two or more stretch regions.

15. A watch band comprising:

a woven material having warp threads and weft threads, the woven material having two or more different stretch regions, wherein tension in a subset of warp threads in a first stretch region transitions from a first tension to a second tension over a length of the first stretch region, wherein tension in the subset of warp threads transitions from the second tension to a third tension over a length of a second stretch region, and wherein a magnitude of a transition in tension of the subset of warp threads in the first stretch region is different from the magnitude of a transition in tension of the subset of warp threads in the second stretch region.

16. The watch band of claim 15, wherein tension in a second subset of warp threads has a constant tension over a length of at least one of the first stretch region and the second stretch region.

17. The watch band of claim 15, wherein the warp threads of the woven material are divided into two or more subsets and only one subset of warp threads per stretch region changes tension over a length of the stretch region.

* * * * *